US005251410A

United States Patent [19]

Carey

[11] Patent Number: 5,251,410

[45] Date of Patent: Oct. 12, 1993

[54] RAIN GUTTER COVER

[76] Inventor: Robert J. Carey, P.O. Box 403, Middletown, N.J. 07748

[21] Appl. No.: 867,392

[22] Filed: Apr. 13, 1992

[51] Int. Cl.[5] ..... E04D 13/06

[52] U.S. Cl. ..... 52/12

[58] Field of Search ..... 52/11, 12, 13, 14, 15, 52/16; 23/267, 260, 261

[56] References Cited

U.S. PATENT DOCUMENTS

| | | | |
|---|---|---|---|
| 3,388,555 | 6/1968 | Foster | 52/12 |
| 4,418,504 | 12/1983 | Lassiter | 52/12 |
| 4,616,450 | 10/1986 | Shouse | 52/12 |
| 4,876,827 | 10/1989 | Williams | 52/12 |
| 4,905,427 | 3/1990 | McPhalen | 52/12 |
| 4,937,986 | 7/1990 | Way, Sr. et al. | 52/12 |
| 5,072,551 | 12/1991 | Manoogian, Jr. | 52/12 |

*Primary Examiner*—Michael Safavi
*Attorney, Agent, or Firm*—R. Gale Rhodes, Jr.

[57] ABSTRACT

Rain gutter cover for being mounted over the top of a rain gutter attached to a building adjacent the bottom edge of a roof upon which rain falls, the rain gutter cover for preventing entrance into the rain gutter of leaves and other debris which cause rain gutter clogging and the stoppage of rain flow into downspouts, including a generally angular upper portion, a generally horizontal bottom portion, and a generally vertical intermediate portion intermediate and interconnecting the upper and bottom portions, the generally angular upper portion for being mounted adjacent the bottom edge of the roof and for transferring rain from the roof to the intermediate portion, the generally vertical intermediate portion provided with at least one generally horizontally disposed row of interrupted slots with adjacent pairs of the slots being interrupted by a solid portion of the intermediate portion, each slot including at least one diagonally disposed upper portion and at least one diagonally disposed lower portion, the diagonally disposed upper portion of predetermined ones of the slots extending generally vertically over the diagonally disposed lower portion of an adjacent slot such that there is no generally vertical path of rainflow down the intermediate portion which is not interrupted by at least one of the slots.

9 Claims, 4 Drawing Sheets

RAIN GUTTER COVER

BACKGROUND OF THE INVENTION

This invention relates to a new and improved rain gutter cover for being mounted on top of a rain gutter and for preventing entrance into the rain gutter of leaves and other debris which cause rain gutter clogging and the stoppage of rain flow into downspouts or leaders.

As is known to those skilled in the rain gutter art, and as is particularly well known to homeowners having plants or shrubs in their yards close to their house, rain gutters are notorious for collecting leaves and other debris which clog the rain gutter and prevent rain flow into the downspouts or leaders whereby the rain gutter overflows and the rain falls down washing away soil adjacent the house, or other building, and frequently washing soil away from plants or shrubs adjacent the house or other building, and possibly causes entrance of rain into the basement of the house or building.

As is further known to those skilled in the rain gutter art, the rain gutter art is replete with various prior art structures for being mounted atop to the typical open prior art rain gutter for preventing leaves and other debris from collecting in the rain gutter. Such other structures are typified by screen or mesh material which is placed over the top of the open rain gutter to prevent the entrance and accumulation of leaves and other debris. However, since the screen or mesh material is placed on the top of the open prior art rain gutter, leaves, or at least leaf particles, and other debris do enter through the openings in the screen or mesh material and, in time, do cause rain gutter clogging and prevention of rain flow through the downspouts or leaders.

Another problem associated with such prior art screen or mesh material is that it has sharp edges which can puncture and cut the hands of the person installing the material and, such screen or mesh material is often damaged in the process of being removed. Further, upon the rain gutter being clogged underneath such installed screen or mesh material, it is extremely difficult, aggravating and annoying to have to frequently remove the screen or mesh material, clean the leaves or other debris out of the rain gutter, and then replace the screen or mesh material.

Accordingly, there exists a need in the rain gutter art for a new and improved rain gutter cover which, upon being mounted on top of the rain gutter requires virtually no further maintenance, or at most very limited further maintenance, which virtually eliminates the need for constant cleaning and unclogging, and which provides substantially uninterrupted flow of rain through the rain gutter to the downspouts or leaders.

Further, there exists a need in the art for a relatively inexpensive device or apparatus for preventing the above-noted rain gutter clogging due to leaves and other debris which falls into the typical prior art rain gutter open at the top. While the RAIN GUTTER disclosed in U.S. Pat. No. 4,411,110 patented Oct. 25, 1983, and the LEADER FILTER disclosed in U.S. Pat. No. 4,615,153 patented Oct. 7, 1986, both issued patents to the same inventor, Robert J. Carey, as the inventor of the present invention, are effective for preventing such clogging, etc., there still exists a need in the art for a comparatively less expensive device or apparatus providing the same prevention of rain gutter clogging which allows the homeowner to buy the cover only instead of the entire gutter as disclosed in U.S. Pat. No. 4,411,110. Still further, the rain gutter cover of the present invention is an improvement over the rain gutter cover of U.S. Pat. No. 5,099,620 patented Mar. 31, 1992 and issued to the same inventor, Robert J. Carey, as the inventor of the present invention.

SUMMARY OF THE INVENTION

The new and improved rain gutter cover of the present invention satisfies the above-noted needs in the prior art and is for being mounted over the top of a rain gutter attached to a building adjacent the bottom edge of a roof upon which rain falls, and includes a generally angular upper portion, a generally horizontal bottom portion, and a generally vertical intermediate portion intermediate and interconnecting the upper and bottom portions, the generally angular upper portion is for interconnecting with the bottom edge of the roof and is for transferring rain from the roof to the intermediate portion, the generally vertical intermediate portion is provided with at least one generally horizontally disposed row of interrupted slots with adjacent pairs of the slots being interrupted by a solid portion of the intermediate portion, each slot including a diagonally disposed upper portion and a diagonally disposed lower portion, the diagonally disposed upper portion of predetermined ones of the slots extending generally vertically over the diagonally disposed lower portion of an adjacent slot such that there is no generally vertical path of rainflow down the intermediate portion which is not interrupted by at least one of the slots.

DESCRIPTION OF THE PREFERRED EMBODIMENTS

Figure 1:
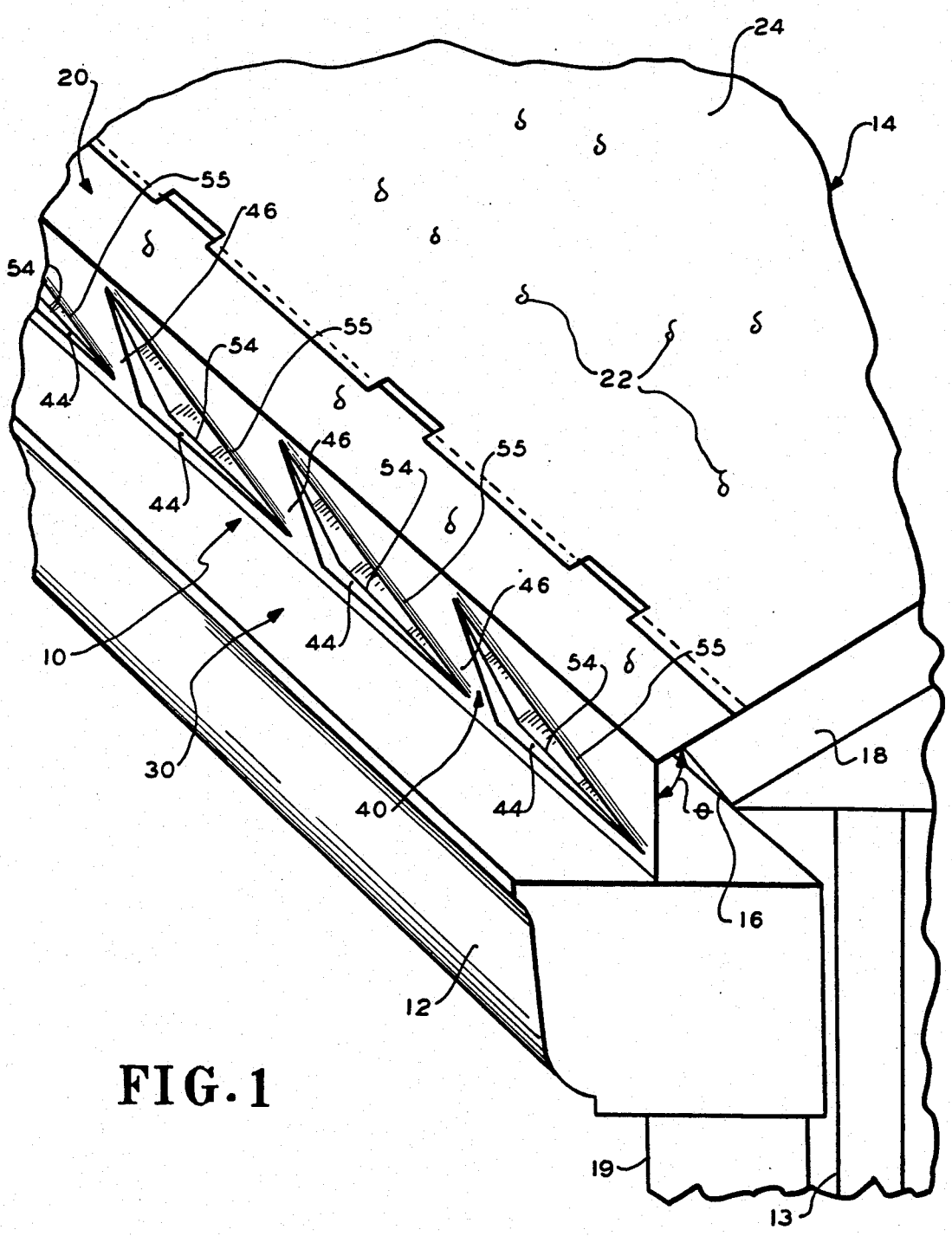
FIG. 1 is a diagrammatic view, in perspective, of a rain gutter cover embodying the present invention shown mounted on the top of a rain gutter attached to a building, the view being a partial perspective view.

Referring now to FIG. 1, there is shown a rain gutter cover embodying the present invention and indicated by general numerical designation 10. The rain gutter cover 10 is for being mounted on top of a rain gutter 12 attached to a facial board 13 of a building 14 adjacent the bottom edge 16 of a roof 18 upon which rain falls. Generally, it will be understood that the rain gutter cover 10 is for preventing entrance into the rain gutter 12 of leaves and other debris which cause rain gutter clogging and the stoppage of rain flow into down spouts or leaders such as leader 19 in FIG. 1.

Figure 2:
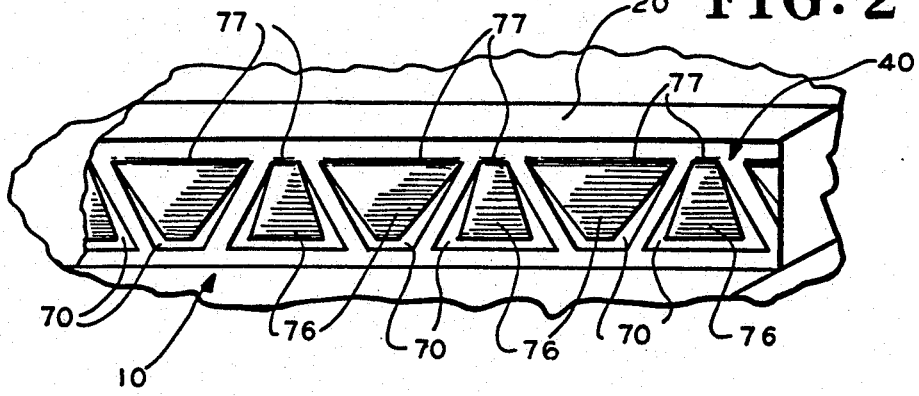
FIG. 2 is a front perspective view of a portion of an alternate embodiment of a rain gutter cover embodying the present invention.

As may be understood by reference to both FIGS. 1 and 2, rain gutter cover 10 includes a generally angular upper portion indicated by general numerical designation 20, a generally horizontal bottom portion indicated by general numerical designation 30, and a generally vertical intermediate portion indicated by general numerical designation 40, intermediate and interconnecting the upper and bottom portions.

The upper angular portion 20, as may be best seen in FIG. 2, is inclined at an included angle 0 with respect to the vertical intermediate portion 40 to orient the upper angular portion 20 generally parallel to the roof 18; the upper angular portion 20 is for transferring rain, represented by rain drops 22, from the roof 18, which may be covered by shingles 24, to the intermediate portion 40.

As may be understood from FIG. 1, the intermediate portion 40 is provided with a generally horizontally disposed row of generally diagonally disposed interrupted slots 44 interrupted by solid portions 46 of the intermediate portion 40. As may be better understood by reference to FIG. 4, each slot 44 includes a diagonally disposed upper portion indicated by numerical designation 50 and a diagonally disposed lower portion indicated by numerical designation 52. It will be particularly understood in accordance with the teachings of the present invention that the diagonally disposed upper portions 50 of the slots 44 extend generally vertically over the diagonally disposed lower portions 52 of an adjacent slot such that there is no generally vertical path of rainflow down the intermediate portion 40 which is not interrupted by at least one of the slots 44. In the embodiment shown in FIGS. 1 and 4, the intermediate portion 40 is provided with a plurality of fins 54 extending inwardly generally at the diagonal.

Figure 4:
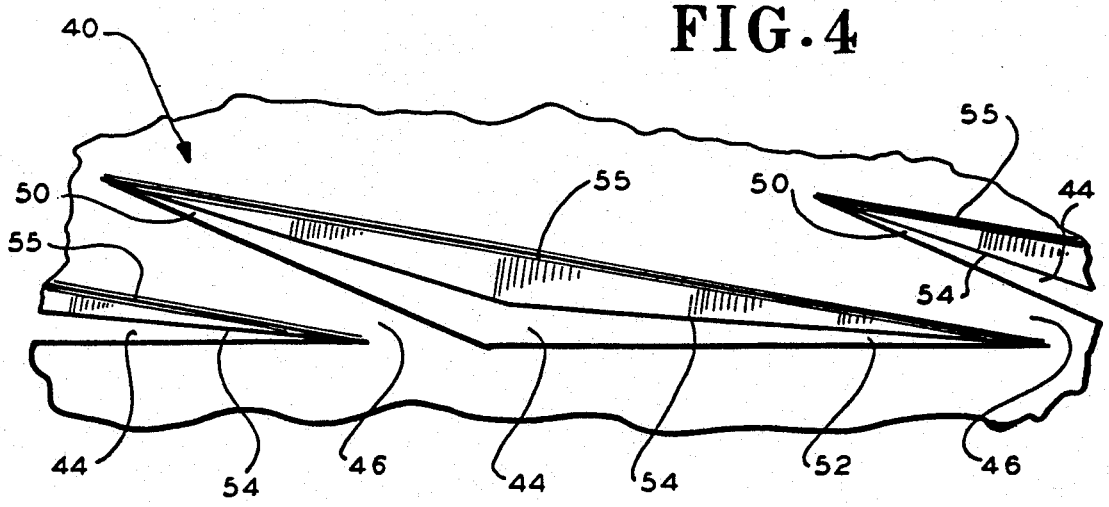
FIG. 4 is an enlarged partial view of the intermediate portion of the rain gutter cover of the present invention shown in FIG. 1.

It will be understood generally that in the alternate embodiments of the rain gutter covers shown in the drawings the covers are made from a sheet of metal, e.g. aluminum, the sheet of metal is cut and bent or folded to produce the upper angular portion 20, the generally horizontal bottom portion 30, and generally vertical intermediate portion 40, that the slots are produced by cuts made in the intermediate portion 40, and that in the alternate embodiments provided with fins the fins are produced by the cuts in the intermediate portions 40 producing the various slots and by subsequently bending the sheet of metal surrounding the slots inwardly. Accordingly, it will be understood that the fins 54 of FIGS. 1 and 4 are produced by cuts in the intermediate portion 40 producing the slots 44 and such cuts are made only along the horizontal bottom line and leftward diagonal line partially defining the slots 44 and that after such cuts are made the sheet of metal generally rightwardly and upwardly of the cuts is bent or folded inwardly. Accordingly, it will be understood that the diagonal lines 55 in FIGS. 1 and 4 are metal fold or bend lines.

Figure 7:
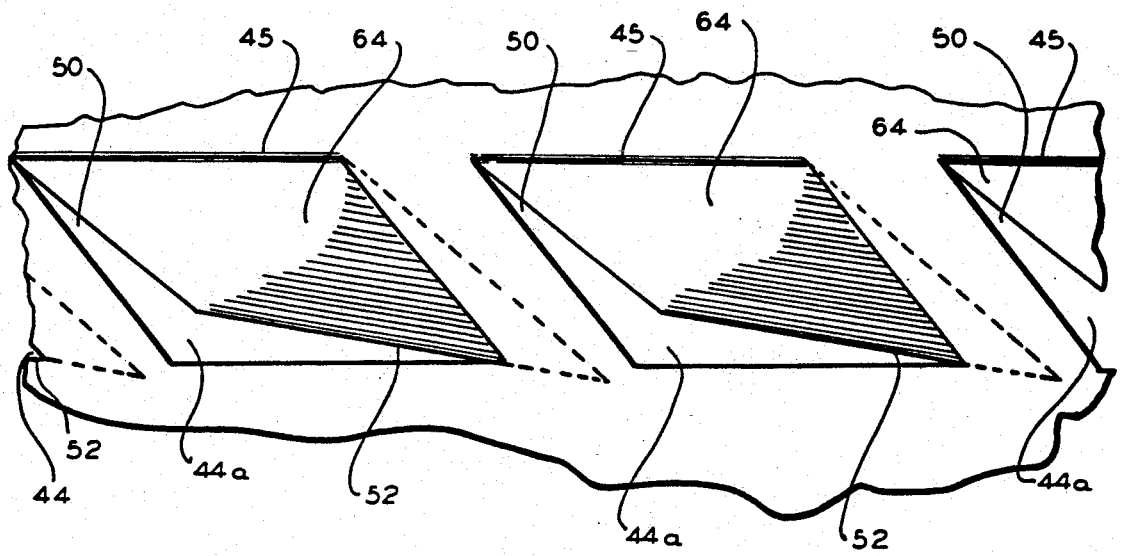
FIG. 7 is an enlarged view similar to FIG. 4 but showing a further alternate embodiment of the rain gutter cover of the present invention.

An alternative embodiment of the rain gutter cover 10 of FIGS. 1 and 4 is shown in FIG. 7 wherein the intermediate portion 40 is provided with a plurality of inwardly extending fins 64. It will be understood that the fins 64 are produced by cuts in the intermediate portion 40 producing the slots **44*a* which are made only along the bottom horizontal line and leftward and rightward diagonal lines defining the slots 44*a* after which the sheet of metal inwardly and upwardly of the cuts is bent or folded inwardly to produce the fins 64. It will be further understood that the lines 45** are metal fold or bend lines.

Figure 5:
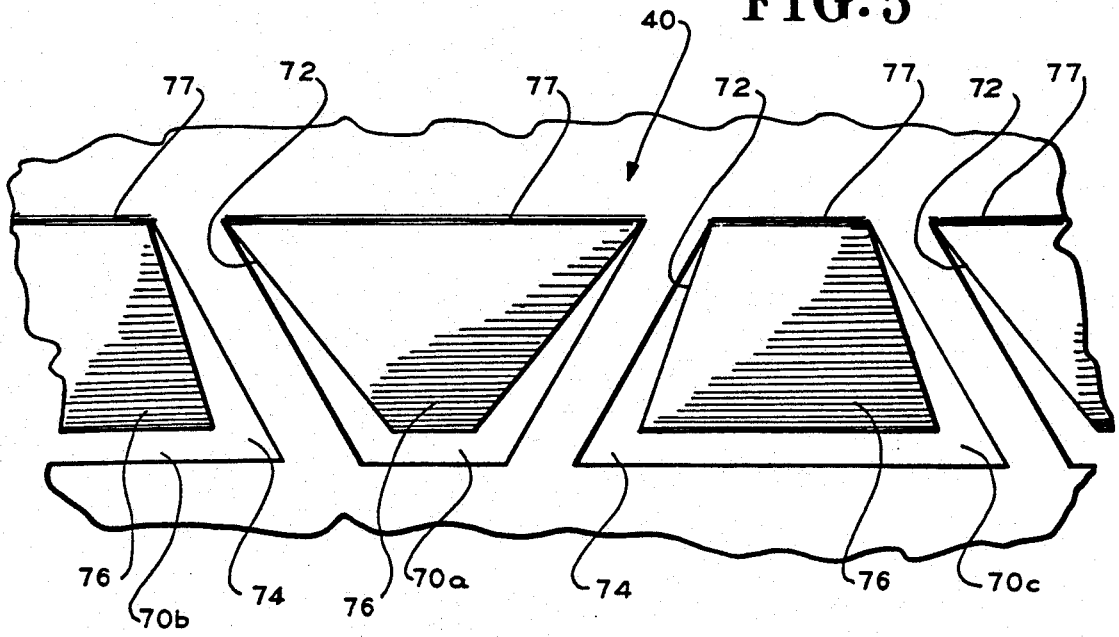
FIG. 5 is an enlarged view of a portion of FIG. 2.

A further embodiment of the rain gutter cover 10 of the present invention is shown in FIG. 2 wherein the intermediate portion 40 is provided with a generally horizontally disposed row of interrupted slots 70 which are generally triangularly shaped and which include generally diagonally disposed side portions; it will be noted that the slots of each pair of adjacent slots 70 are inverted with respect to each other. As may be better understood by reference to enlarged FIG. 5, and with regard to representative slot **70*a*, that slot 70*a* includes diagonally disposed upper portions 72 which extend generally vertically over the diagonally disposed lower portion 74 of adjacent slots 70*b* and 70*c* whereby there is no generally vertical path of rainflow down the intermediate portion 40 which is not interrupted by at least one of the slots. It will be understood by reference to FIGS. 2 and 5 that in this embodiment the intermediate portion 40 of the rain gutter cover 10 is provided with a plurality of generally inwardly extending fins 76. It will be further understood that the fins 76 are provided by cuts made in the intermediate portion 40 procuring the slots 70 and that such cuts are made only along the horizontal bottom line and leftward and rightward diagonal lines defining the slots 70, and that after such cuts are made the sheet metal adjacent such slots and inwardly and upwardly thereof is bent or folded inwardly to produce the fins 76; the lines 77 shown in FIGS. 2 and 5 are metal fold or bend lines. In a further alternate embodiment, FIGS. 2 and 5, the intermediate portion 40 may not be provided with inwardly extending fins and the slots 70 may be formed by cutting along all the horizontal and diagonal lines defining the slots 70**.

Figure 3:
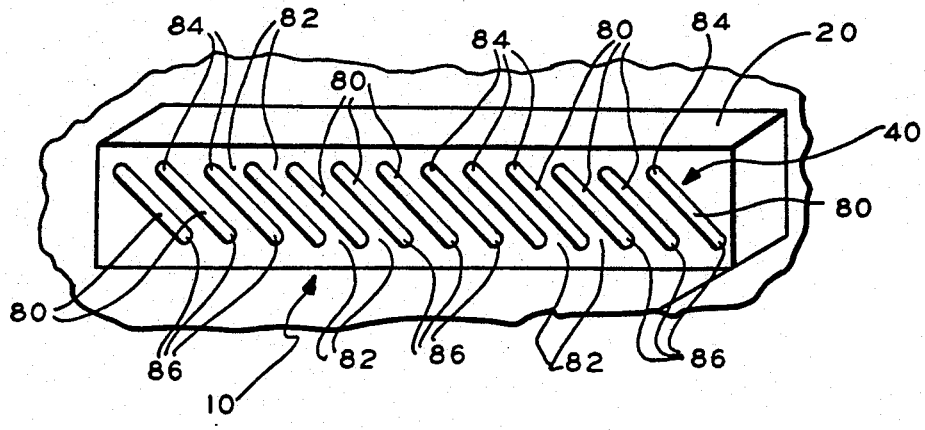
FIG. 3 is a front perspective view of a portion of a further alternate embodiment of a rain gutter cover embodying the present invention.
Figure 6:
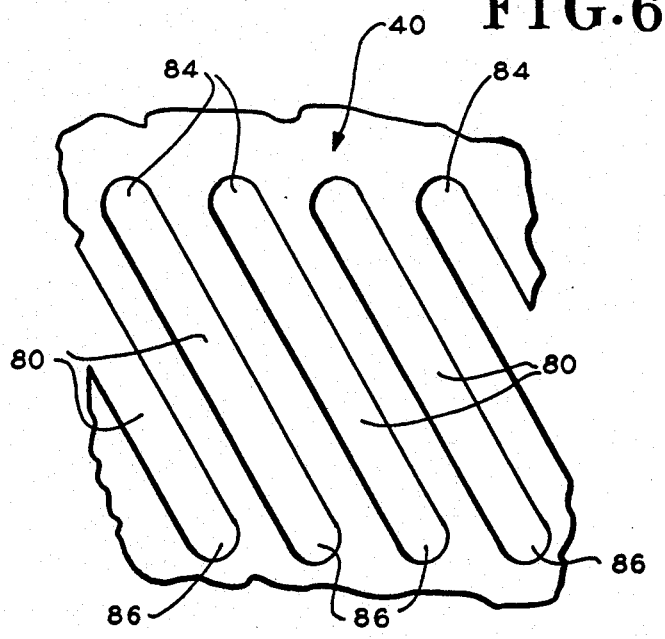
FIG. 6 is an enlarged view of a portion of FIG. 3.
Figure 8:
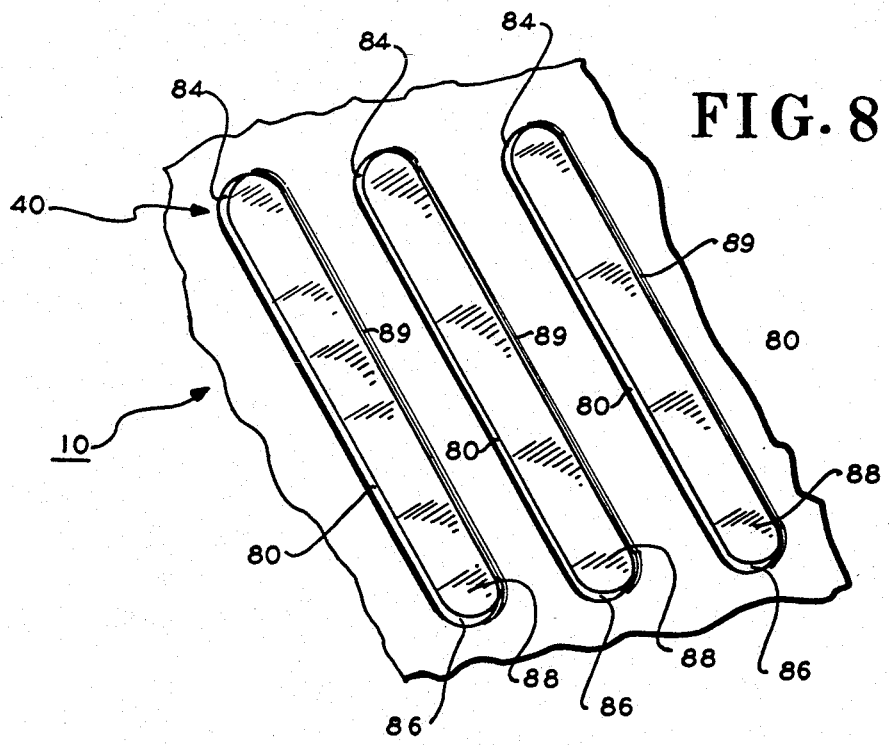
FIG. 8 is a view similar to FIG. 6 but showing a still further alternate embodiment of a rain gutter cover embodying the present invention.

Referring now to FIG. 3, in this alternate embodiment of the rain gutter cover 10 of the present invention the intermediate portion 40 is provided with a generally horizontally disposed row of generally diagonally disposed oblong slots 80 interrupted by solid portions 82 of the intermediate portion 40. The slots 80 are provided with diagonally disposed upper portions indicated by numerical designations 84 and diagonally disposed lower portions indicated by numericals designation 86. From enlarged FIG. 6 it will be better understood that the diagonally disposed upper portions 84 of the diagonally disposed oblong slots 80 extend generally vertically over the diagonally disposed lower portions 86 of adjacent slots 80 such that there is no generally vertical path of rain flow down the intermediate portion 40 which is not interrupted by at least one of the slots. A still further alternate embodiment of the diagonally disposed oblong slots is shown in FIG. 8 wherein it will be understood that the intermediate portion 40 of the rain gutter cover 10 is provided with a plurality of generally inwardly extending fins 88 and from FIG. 8 it will be understood that the fins 88 are produced by cuts in the intermediate portion 40 which produce the slots 80 and that such cuts are made only along the leftward diagonal line and leftward portions of the outwardly curved top and bottom lines defining the slots 80. After such cuts are made the rightward metal adjacent the cuts is bent or folded inwardly to produce the fins 88. Thus it will be understood that in FIG. 8 the rightward diagonal lines 89 are metal fold or bend lines.

In brief general review, it will be understood that in each of the various alternate embodiments of the rain gutter cover of the present invention described above and shown in the drawings the slots are shaped, generally diagonally, to substantially assure that there is no generally vertical path of rainflow down the intermediate portion 40 which is not interrupted by at least one slot. This substantially assures that the rain flow from the roof, e.g. building roof 18 of FIG. 1, is diverted into the gutter 12 of FIG. 1 and substantially prevented from falling to the ground beneath the rain gutter and washing away soil, plants or shrubs adjacent the building and substantially preventing entrance of rain into the basement of a house or building. It will be further understood that the sizes of the above-described slots, which slots are shown in the drawings, are of a size so as to substantially prevent the entrance into the slots of leaves or other debris and thus such leaves or debris are substantially prevented from entering the rain gutter 12 of FIG. 1 and clogging down spouts or leaders such as leader 19 of FIG. 1.

It will be still further understood that the various rain gutter cover embodiments of the present invention are an improvement over prior art rain gutter covers, such as that disclosed in the above-identified U.S. Pat. No. 5,099,620 because only a single horizontal row of the slots in the present invention is required to assure that there is no generally vertical path of rain flow down the intermediate portions 40 of the alternate rain gutter cover embodiments of the present invention which path is not interrupted by at least one slot, whereas the prior art rain gutter covers, particularly the aforenoted patents, require at least two horizontally disposed rows of slots to assure that there is no generally vertical path of rain flow down the intermediate portion of such prior art rain gutter covers which is not interrupted by at least one slot. By accomplishing this result with only a single generally horizontally disposed row of generally diagonally disposed slots, the rain gutter cover embodiments of the present invention may be made less expensively than the prior art rain gutter covers requiring at least two horizontal rows of slots to accomplish the same result. However, if desired, a rain gutter cover may be provided with a plurality of rows of horizontal slots of the types disclosed herein.

Alternative to being made from sheet metal as taught above, the alternate embodiments of the rain gutter covers herein may be made from a suitable plastic, such as PVC, and shaped as shown in the drawings by suitable plastic shaping techniques known to the art.

It further will be understood by those skilled in the art that many modifications and variations of the present invention may be made without departing from the spirit and the scope thereof.

What is claimed is:

1. Rain gutter cover for being mounted over the top of a rain gutter attached to a building adjacent the bottom edge of a roof upon which rain falls, said rain gutter cover for preventing entrance into the rain gutter of leaves and other debris which cause rain gutter clogging and the stoppage of rain flow into downspouts, comprising:

a generally angular upper portion, a generally horizontal bottom portion, and a generally vertical intermediate portion intermediate and interconnecting said upper and bottom portions;

said generally angular upper portion for being mounted adjacent said bottom edge of said roof and for transferring rain from said roof to said intermediate portion;

said generally vertical intermediate portion provided with a single horizontally disposed row of interrupted slots with adjacent pairs of said slots being interrupted by a solid portion of said intermediate portion, each slot including at least one diagonally disposed upper portion and at least one diagonally disposed lower portion, said diagonally disposed upper portion of predetermined ones of said slots extending generally vertically over said diagonally disposed lower portion of an adjacent slot such that there is no generally vertical path of rainflow down said intermediate portion which is not interrupted by at least one of said slots; and said upper and intermediate portions covering a portion of the top of said rain gutter and said bottom portion covering the balance of the top of said rain gutter.

2. The rain gutter cover according to claim 1 wherein each of said slots is a generally oblong, diagonally disposed slot.

3. The rain gutter cover according to claim 1 wherein each of said slots is a generally triangularly shaped slot wherein the slots of adjacent pairs of slots are inverted with respect to each other.

4. The rain gutter cover according to claim 1 wherein each of said slots is defined by generally horizontally disposed top and bottom portions and by generally diagonally disposed side portions interconnecting said top and bottom portions.

5. The rain gutter cover according to claim 4 wherein said side portions are inclined in the same direction.

6. The rain gutter cover according to claim 4 wherein said side portions are inclined in opposite directions whereby said slots are generally triangularly shaped slots and whereby the slots of adjacent pairs of generally triangularly shaped slots are inverted with respect to each other.

7. The rain gutter cover according to claim 6 wherein said intermediate portion is provided with a plurality of fins extending inwardly from said top portions of said slots, said fins for receiving rain flowing down said intermediate portion and for diverting said rain into said rain gutter.

8. The rain gutter cover according to claim 4 wherein said intermediate portion is provided with a plurality of fins extending inwardly from said top portions and one of said side portions of said slots.

9. The rain gutter cover according to claim 2 wherein each of said slots is defined by outwardly curved top and bottom portions and diagonally disposed side portions, and wherein said intermediate portion is provided with a plurality of fins each extending inwardly generally from one of said diagonally disposed side portions.

* * * * *